United States Patent [19]

Kendall

[11] Patent Number: 4,658,762

[45] Date of Patent: Apr. 21, 1987

[54] ADVANCED HEATER

[75] Inventor: Robert M. Kendall, Sunnyvale, Calif.

[73] Assignee: Gas Research Institute, Chicago, Ill.

[21] Appl. No.: 828,024

[22] Filed: Feb. 10, 1986

[51] Int. Cl.[4] ..... F22B 21/00

[52] U.S. Cl. ..... 122/250 R; 122/18; 122/356; 431/328

[58] Field of Search ..... 122/14, 18, 250 R, 356; 431/328

[56] References Cited

U.S. PATENT DOCUMENTS

| | | | |
|---|---|---|---|
| 2,182,586 | 12/1939 | Heid | 122/356 |
| 2,346,348 | 4/1944 | Barnes | 122/356 |
| 2,527,410 | 10/1950 | Fleischer | 122/356 |
| 3,105,467 | 10/1963 | Griffith | 122/356 |
| 3,110,300 | 11/1963 | Brown et al. | 126/109 |
| 3,169,752 | 2/1965 | Constance et al. . | |
| 3,200,874 | 8/1965 | Koppel . | |
| 3,291,104 | 12/1966 | Zimmerman | 122/240 |
| 3,384,052 | 5/1968 | Zimmerman | 122/356 |
| 3,425,675 | 2/1969 | Twine | 263/41 |
| 3,485,230 | 12/1969 | Harrington et al. | 126/92 |
| 3,610,791 | 10/1971 | Iacaccia | 431/67 |
| 4,019,466 | 4/1977 | Reed | 122/367 R |
| 4,035,132 | 7/1977 | Smith | 431/7 |
| 4,039,275 | 8/1977 | McGettrick | 431/329 |
| 4,089,303 | 5/1978 | Brulfert | 122/250 R |
| 4,272,237 | 6/1981 | Smith | 431/328 |
| 4,290,746 | 9/1981 | Smith | 431/328 |
| 4,373,904 | 2/1983 | Smith | 431/328 |
| 4,400,152 | 8/1983 | Craig et al. | 431/328 |
| 4,442,799 | 4/1984 | Craig et al. | 122/250 R |
| 4,494,485 | 1/1985 | Kendall et al. | 122/18 X |

*Primary Examiner*—Edward G. Favors

*Attorney, Agent, or Firm*—Flehr, Hohbach, Test, Albritton & Herbert

[57] ABSTRACT

An advanced compact heater which includes a radiant section of tube coils nested about a plurality of tiers of vertically spaced-apart fiber matrix burners. Each burner is comprised of a hollow cylindrical shell of a fiber matrix material with an oval cross-section of optimum height-to-width aspect ratio and a long length-to-height aspect ratio. A process fluid or water is directed through the radiant coil of tubes disposed in vertical arrays on opposite sides of the burner tiers. Pre-mixed fuel and air flamelessly combusts on the active sections of the burner surfaces permitting narrow burner-to-coil spacing with a compact heater size and reduced capital cost in relation to the heat input rating. Exhaust from the burners flows in heat exchange relationship past tube coils in a convective section for extraction of residual heat.

10 Claims, 4 Drawing Figures

ADVANCED HEATER

This invention relates to apparatus and processes for heating fluids for use in the petroleum, chemical and related industries. The invention has application in these industries for hydrocarbon heating and petroleum refining such as high-temperature cracking of hydrocarbon gases, thermal polymerization of light hydrocarbons, hydrogenation of oils, and steam generation.

In the petroleum industry natural gas is the largest segment of purchased fuel and supplies one-quarter of the industry's total energy needs. Approximately two-thirds of this natural gas has been employed in refinery heaters. Heretofore these heaters have been both thermally inefficient and a source of considerable $NO_x$ emissions. Conventional heaters are also relatively large in size requiring substantial steelwork which is costly to fabricate and erect.

Accordingly, it is a principal object of the present invention to provide a new and improved heater for use in the process and related industries which obviates the disadvantages and limitations of existing heaters.

Another object is to provide a heater which is smaller in size and relatively more compact in relation to conventional heaters having comparable heat input ratings.

Another object is to provide a heater of the type described which can be constructed with reduced capital cost and reduced site area requirements as compared to conventional heaters of comparable heat input ratings.

Another object is to provide a heater of the type described which operates with reduced $NO_x$ emissions and with less noise in comparison to conventional heaters of comparable ratings, and which eliminates the need for post-combustion cleanup equipment.

Another object is to provide a heater of the type described which reduced the risk of tube coking and burnout.

The invention in summary includes a heater employing fiber matrix burners which radiantly heat tube coils which contain the process fluid or water. The burners comprise hollow cylindrical shells of either circular or oval cross section. The burners may be mounted horizontally in vertically spaced-apart relationship in tiers about which the tube coils are nested. They also may be mounted vertically. Premixed fuel and air directed into the burners flow outwardly and flamelessly combusts on the outer surfaces to radiantly heat the tube surfaces. The heater provides a high heat generating capacity in a compact structure of smaller size and cost in comparison to conventional heaters of comparable ratings.

The foregoing and additional objects and features of the invention will appear from the following specification in which the several embodiments have been described in conjunction with the accompanying drawings.

Figure 1:
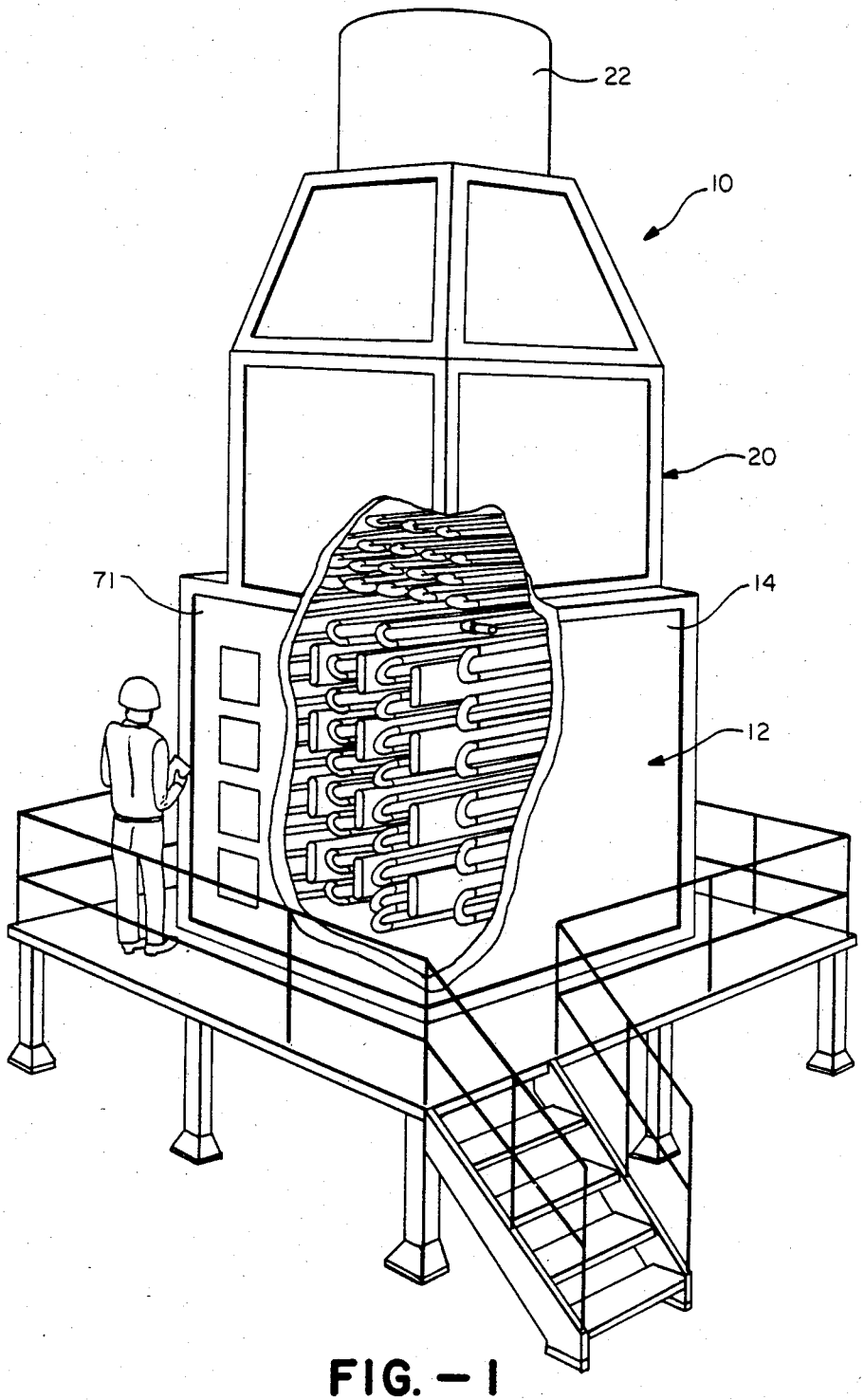
FIG. 1 is a perspective view, partially broken-away, of an advanced heater incorporating the invention.

The drawings illustrate a preferred embodiment of the invention providing an advanced heater 10 of the box or cabin type. The heater 10 includes at its lower end a radiant section chamber 12 confined by an outer wall structure comprises side walls 14, 15 and floor 16. At its upper end the heater includes a convective section chamber 18 within a cupola 20. The cupola opens into a stack 22 for venting exhaust gases.

The radiant section is comprised of a horizontal setting of tube coils disposed in vertical arrays 24–30 which are nested about and spaced from a plurality of horizontally-extending, elongate cylindrical fiber matrix burners in rows 32–38. The burners are mounted in vertical spaced-apart relationship in a plurality of tiers 40, 42, 44 with the tube coils arrayed on opposite sides of each of the tiers.

In the illustrated embodiment four of the fiber matrix burners comprise each tier. The number of burners in a tier, and the number of tiers within the heater, will vary according to the specifications and requirements of a particular application.

Figure 3:
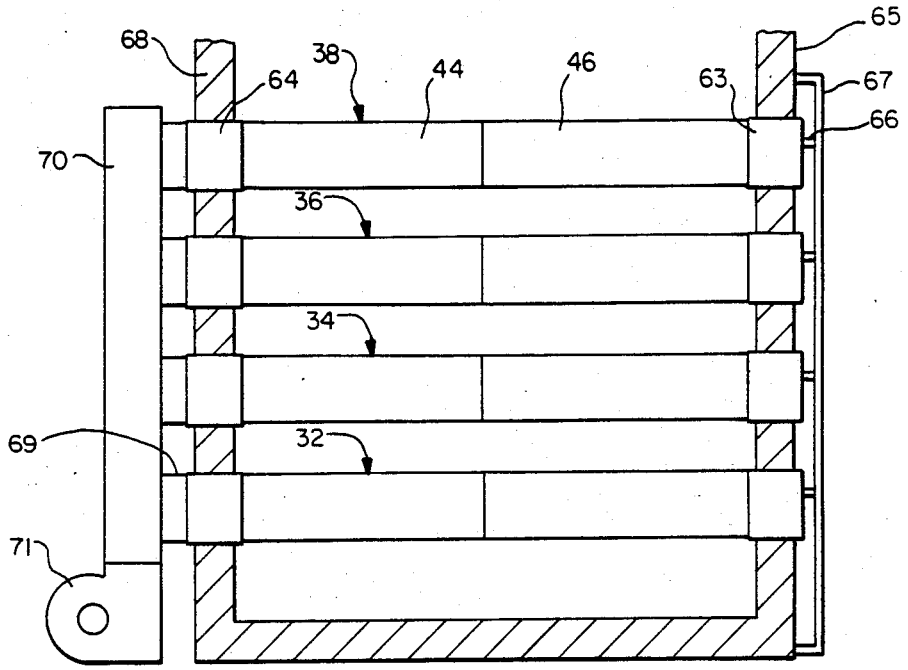
FIG. 3 is a cross sectional view taken along the line 3—3 of FIG. 2.

Each burner 32–38 is comprised of a plurality of burner segments 44 and 46, and as shown in FIG. 3 for the illustrated embodiment two segments are mounted in tandem to form each of the elongate cylindrical burners.

Figure 4:
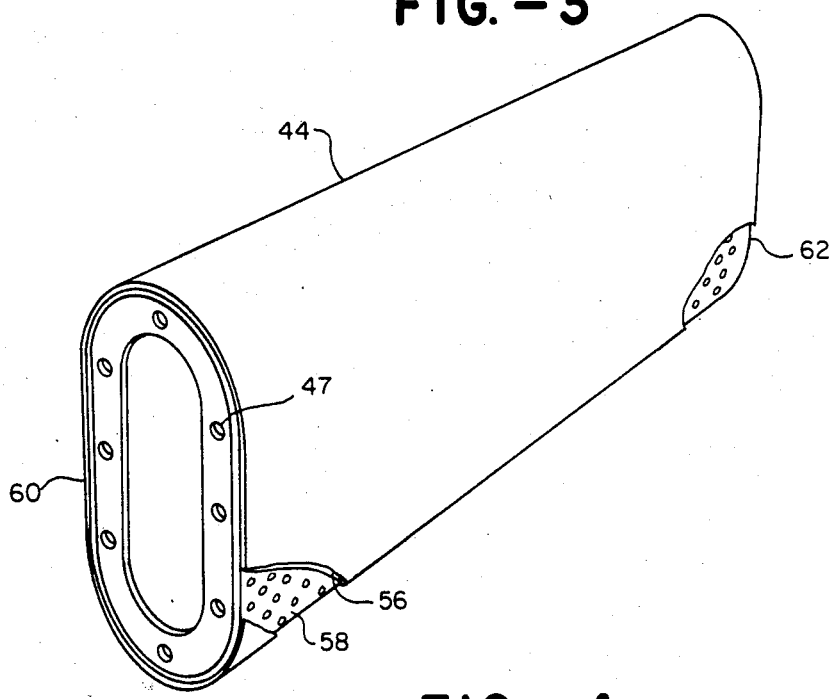
FIG. 4 is a perspective view to an enlarged scale illustrating a typical segment of one of the burner units used in the heater of FIG. 1.

The burner segment 44 illustrated in FIG. 4 is typical and is comprised of a fiber matrix shell 56 of elongate cylindrical shape carried about a perforate support screen 58 which in turn is mounted between a pair of endplates or flanges 60, 62. The cross-sectional shape of the shell can be circular or oval, and in the heater of the illustrated embodiment the burner shape is oval. The oval configuration provides an optimum radiant view factor to the tube coils in that the flat burner sides have a large radiant surface area relative to the top and bottom sides. Preferably the height-to-width H/W aspect ratio of the burner cross section is in the range of 1.5 to 12 to provide the optimum radiant view factor. The burner segments are mounted together in tandem by bolts and truss rods, not shown, inserted through holes 47 formed in the endplates.

Burner shell 56 is comprised of a porous layer of ceramic fibers which flamelessly combusts premixed gaseous fuel and air at the burner surface. Preferably the composition and method of formulation of the porous layer is by a vacuum-forming process from a slurry composition of ceramic fibers, binding agent, catalysts and filler. The layer is capable of being vacuum-formed into various configurations, including the cylindrical configuration of the burners employed in the present invention. The interface between the edges of the active porous layer and the inactive metal flanges are sealed by a suitable temperature-resistant adhesive composition.

Each burner includes a rear inactive end segment 63 and a front inactive end segment 64. The rear inactive end segment may project through an aperture in heater rear wall 65 to support and/or seal the burner end. The end segment 63 may carry a mounting pin 66 which fits within a notch of a support tray 67 on the outside of the rear wall. Front end segment 64 projects through an aperture formed in heater front wall 68 and is connected through branch conduits 69 with a manifold 70 which directs pre-mixed fuel and air into the burners. Gas-tight seals are provided about the interfaces between the wall apertures and inactive end segments 63 and 64. A suitable butterfly-type control valve, not shown, may be provided in the manifold to control the flow rate of fuel/air mixture into the burners and thereby control the firing rate. A blower 71 forces pressurized air into the manifold, and a fuel such as natural gas is injected into the airstream under control of a suitable gas valve, also not shown. The fuel/air mixture flows into each burner along the plena within the inner volume of burner shell 56. The mixture flows outwardly through the interstitial spaces between the fibers of the matrix and ignites on the outer surface of flamelessly combust. The active surface incandescently glows and transfers heat primarily by radiation to the surrounding tube walls.

Depending upon the requirements of a particular application the entire outer surface of each burner can be combustibly fully active, or selected zones or surface area portions of the burners could be combustibly less active or inactive. In the case where fully-active burners are utilized, the burners in each tier are spaced sufficiently far apart to avoid overheating of the facing top and bottom sides of the adjacent burners. A more compact heat configuration can be achieved by utilizing burners having fully-active side walls facing the tube coils and inactive or less active top and bottom side walls in accordance with the invention or the copending application Ser. No. 828,039, filed Feb. 10, 1986, entitled Zone Controlled Radiant Burner of Robert M. Kendall et al. which is assigned to the assignee of the present invention. The disclosure of the Zone Controlled Radiant Burner patent application is incorporated herein by this reference. Utilization of the zone-controlled radiant burners incorporating inactive or less active top and bottom surface portions permits adjacent burners in each tier to be mounted in closer spaced relationship without destructive overheating, and this achieves a greater heat flux per unit volume so that a more compact and smaller heater can be constructed with an equivalent heat input rating. When utilizing burners in accordance with the Zone Controlled Radiant Burner application disclosure, the fuel/air mixture can be bled at a reduced rate through apertures formed in baffles which separate the plena between the active and less active sections. Additionally, fuel/air control valves and baffling can be provided in the inlet manifolds and burners to form plena for feeding separate streams of fuel/air and air to the active and inactive or less active burner surfaces.

The configuration of heater 10 employing two segments for each burner is suitable for relatively small size installations, for example for a heater with the inner volume of the radiant section comprising a base on the order of $7' \times 7'$ and a height of $7\frac{1}{2}'$ and containing twelve burners generating a total heat input of 12 MMBtu/hr. For large installations the invention contemplates the use of longer burners in a large volume radiant section. For the larger installations the burners can each be comprised of three or more burner segments connected to tandem and supported on horizontal beams as provided in the copending application Zone Controlled Radiant Burner of Kendall et al. Preferably the burner length-to-height L/H aspect ratio is in the range of 1.5 to 30 to provide an optimum relationship between the active burner surface area and fabrication, handling, installation and mechanical strength characteristics of the burners.

Figure 2:
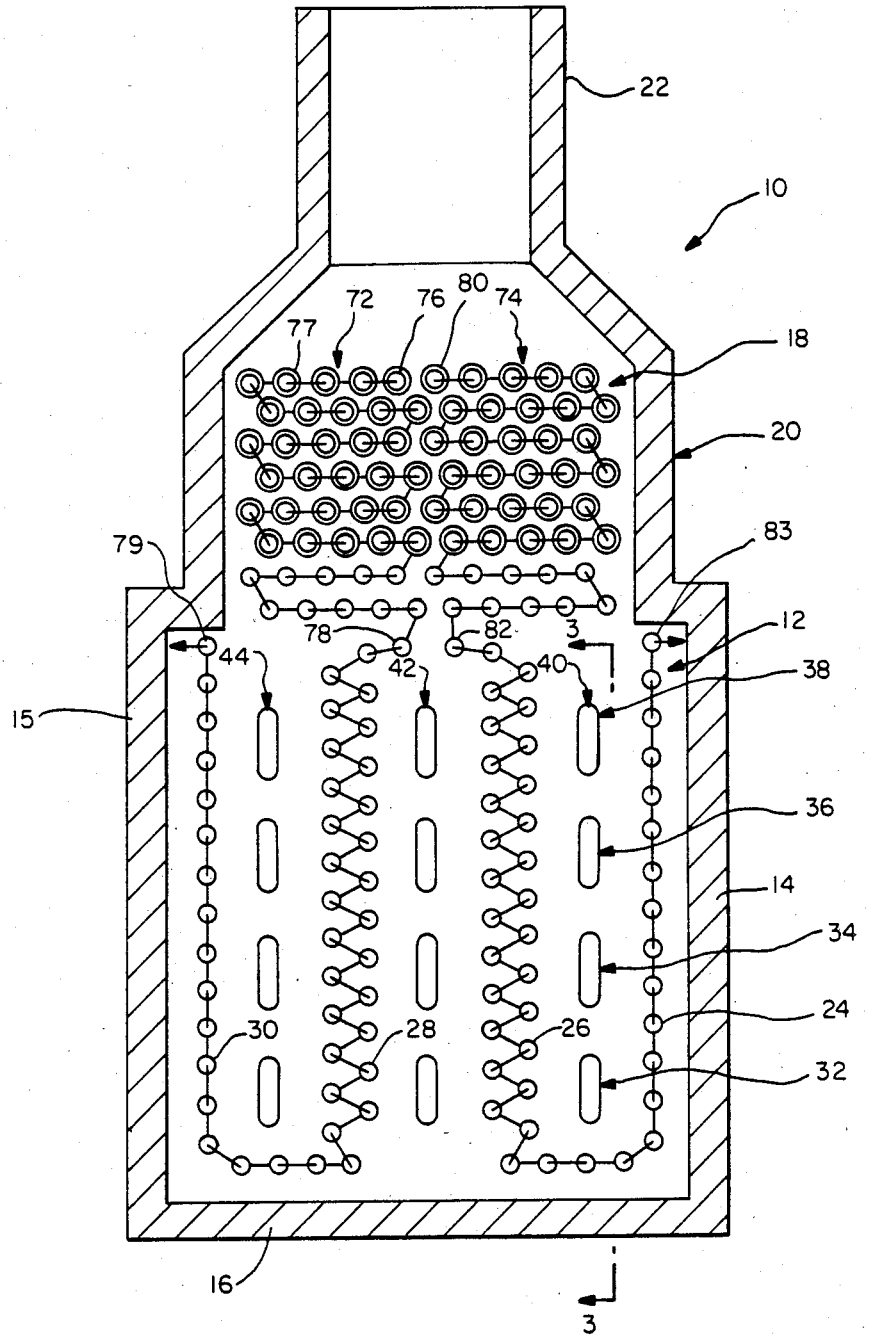
FIG. 2 is a vertical cross sectional view of the heater of FIG. 1.

In the illustrated embodiment, heater 10 includes heat exchange tubes containing the process fluid, or water, as the case may be, in two separate tube coils 72, 74, each of which forms a part of both the convective section 18 and radiant section 12. The tube coil 72 leads from an inlet end 76 through interconnected turns on the left side, as viewed in FIG. 2, within cupola 20 to form half of the convective coil. Preferably the runs of tubes within the convective section are provided with fins 77 to enhance the heat transfer efficiency. The tube coil 72 continues through interconnected turns forming horizontally flat arrays which step vertically downwardly and connect at 78 with the upper end of vertical coil array 28 on the left side of radiant section 12. The coil array 28 continues down between the pair of tiers 42 and 44, and alternate runs of the tubes in this array are laterally offset and vertically staggered to provide optimum view factors with the burners. Coil array 28 continues through a series of interconnected turns under the bottom of burner tier 44 and connects with coil array 30 which extends vertically upwardly between the tier and outer heater wall 15. The upper outlet end of this coil is connected at 79 through a conduit, not shown, leading out through the heater wall. The opposite coil 74 similarly leads from an inlet end 80 down through a series of interconnected runs of finned tubes which form the right side, as viewed in FIG. 2, of the convective section. Coil 74 connects at 82 with the upper end of vertical coil array 26 on the right side of the radiant section. The coil array 26 continues downwardly between the burner tiers 40 and 42 through a series of interconnected tube runs which are laterally offset and vertically staggered. This coil continues through a series of turns underneath tier 40 and connects with coil array 24 which extends vertically upwardly between tier 40 and heater wall 14. The outlet end of coil array 24 connects at 83 through a conduit, not shown, leading out through the heater wall. Details of tube support, drainage, and other conventional requirements are not shown.

The following is an example of the use and operation of the invention. A process heater is constructed in accordance with FIGS. 1–4 with each side wall 14, 15 of 6" thickness having an exterior width of 8' and height of $8\frac{1}{2}'$. The dimensions of the interior volume of the radiant section 12 is a $7' \times 7'$ square base and height of $7\frac{1}{2}'$. The interior volume of the convective section 18 has a base of $5\frac{1}{2}' \times 7'$ with a height of 6' to the top of the convective coils. A total of twelve burners 32–38 are provided with four horizontally mounted burners in each of three tiers. Each burner is comprised of two burner segments 44 and 46, each of which has a length of $3\frac{1}{2}'$ with an oval cross-section having a heigh to 12" and a width of 3". Using pre-mixed air and natural gas fuel each burner generates 1 MMBtu/hr of heat input at a specific heat input rate of 100 MBtu/hr/ft$^2$ of burner area. With all twelve burners operating a full capacity the heater will generate 12 MMBtu/hr heat input.

During operation of heater 10 the gas and air valves are controlled to direct streams of a pre-determined mixture of fuel and air into the plena of the burners. The mixture flows outwardly through the fiber matrix material and is ignited on the burner surfaces by a suitable pilot flame or glow plug igniter, not shown. The fuel/air mixture flamelessly combusts uniformly about the entire active burner surface. In the case where zone controlled radiant burners are employed, the top and bottom surface portions of the burners are either combustibly inactive or less active. On the active burner surfaces the combustion generates an incandescent, hot surface which transfers the burner's heat output primarily by radiation with a uniform heat flux to the opposing heat sink comprising the radiant tube coils. Exhaust gases from the burners flow upwardly between the tube coils in convective section 18. The convective coils absorb a substantial portion of the residual heat in the exhaust gases, which are then directed away through flue 22, where the inclusion of a combustion air preheater or other waste heat recovery system is comtemplated.

The novel burner configuration and placement of burner tiers between the tube coils together with the nature of flameless combustion of the burners affords much narrower burner-to-coil spacing in the radiant section as compared to heaters of conventional design. This reduces the heater volume, and required steelwork, in comparison to conventional box or cabin type heaters of comparable ratings. The capital cost for fabrication and erection of the heaters, and site area requirements, are thereby lowered.

In the invention the more uniform heat flux, and absence of flame impingement, provided by the fiber matrix burners reduces the risk of coking and burnout of the radiant section tubes. Reduced coking and burnout reduces the maintenance required on the tubes. By transferring more of the heat energy to the radiant coils, the invention will improve the process throughout capacity in comparison to existing heaters of comparable heat input ratings.

The fiber matrix burners of the invention are characterized in having a low conductivity of the fibers which, coupled with the conductive cooling from the incoming flow of reactants, allows the burners to operate safely without flashback. The burner units are also quieter in operation in that they produce none of the aerodynamic combustion noise associated with burners having supported flames. The burners of the invention furthermore turn on and off instantly from a pilot flame or igniter, and are not susceptible to thermal shock. The burners also operate at very low excess air levels and with low pressure drop. Due to the low combustion temperatures of the fiber layers, which suppresses thermal $NO_x$ formation, the burners will emit less than 15 ppm $NO_x$ and low CO and hydrocarbon emissions. In addition, $NO_x$ emission levels are nearly independent of the environment, such as the heat sink temperature into which the burner is radiating or combustion air preheat. This eliminates the need for post-combustion clean up apparatus.

The heat input of the burner segments is a function of the active surface area so that the burner units can be scaled to the desired heat input requirements. In addition, the number of burner segments assembled to form a burner unit, and the number of burner units in a tier, can be varied according to the requirements of a particular application.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A heater for generating a high heat input capacity in a compact configuration comprising the combination of an outer wall structure defining a chamber which includes two coils forming a radiation section, at least two burner tiers within the chamber, each tier comprising a plurality of elongate cylindrical fiber matrix burners mounted in spaced-apart relationship, the radiant section of tube coils including tubes spaced from opposite sides of the burners in each tier, each burner being comprised of a hollow shell formed of a fiber matrix material having interstitial space between the fibers, and means for directing streams of pre-mixed fuel and air into the burners with the mixture flowing outwardly through the matrix and flamelessly combusting on the outer surface of the burners with heat transfering primarily by radiation to the tube coils.

2. A heater as in claim 1 in which the burners are formed with oval cross-sections having substantially flat side walls and arcuate top and bottom sides with the flat side walls providing optimum view factors for radiating energy to the tube coils.

3. A heater as in claim 2 in which the oval cross-sectional dimensions of the burners have a height-to-width aspect ratio H/W between 1.5 and 12 where H is the vertical height of the burner and W is the lateral width of the burner, and the side walls of the burners radiate a substantial portion of heat flux from the burners.

4. A heater as in claim 3 in which the length-to-height aspect ratio L/H is at least 6 where L is the total length of the active portion of each burner.

5. A heater as in claim 1 in which the vertical spacing between adjacent burners is optimum to minimize overheating of facing surface portions of the adjacent burners.

6. A heater as in claim 1 in which the tube coils of the radiant section include interconnected parallel tubes mounted in arrays in space-apart relationship from opposite sides of the burner tiers whereby the active surfaces of the burners are exposed to tube surfaces in the arrays.

7. A heater as in claim 1 which includes a convective coil of tubes mounted above the radiant section, and exhaust gases from the burners flow in heat exchange relationship with the convective coil for absorbing residual heat from the exhaust gases.

8. A method for heating a process fluid or water in a heater structure of compact configuration, including the steps of holding a plurality of elongate cylindrical burners having porous fiber matrix walls in spaced relationship in a plurality of spaced-apart tiers within the heater structure, passing pre-mixed fuel and air outwardly through the walls of each burner, flamelessly combusting the fuel and air on the outer surface of each burner with the outer surface reaching incandescence for transferring heat outwardly from the burner primarily by radiation, passing the processed fluid or water through coils of tubes forming the radiant section of the heater, and holding the radiant section tube coils in two arrays spaced from opposite sides of the burners in each of the tiers at a distance which provides optimum heat flux and with the flameless combustion of the burners obviating destructive overheating of the tube coils.

9. A method as in claim 8 in which the process fluid or water is directed through a coil of tubes in a convective section interconnected with the tubes of the radiant section, and exhaust gases from the burners are directed along a path in heat exchange relationship with the convective section tube coils.

10. A method as in claim 8 in which the burners in each tier have vertically flat sides and arcuate top and bottom sides, and the portion of the fuel/air mixture combusted on the flat sides is greater than the portion combusted on the top and bottom sides of each burner whereby the substantial portion of the heat flux is radiated from the flat sides.

* * * * *